US009236239B1

(12) United States Patent
Kalymon

(10) Patent No.: US 9,236,239 B1
(45) Date of Patent: Jan. 12, 2016

(54) SAFETY NET FOR A LIGHT BULB CHANGER

(71) Applicant: Jan Kalymon, Carnegie, PA (US)

(72) Inventor: Jan Kalymon, Carnegie, PA (US)

( * ) Notice: Subject to any disclaimer, the term of this patent is extended or adjusted under 35 U.S.C. 154(b) by 0 days.

(21) Appl. No.: 14/731,107

(22) Filed: Jun. 4, 2015

(51) Int. Cl.
*H01K 3/32* (2006.01)
*H01J 9/00* (2006.01)

(52) U.S. Cl.
CPC . *H01K 3/32* (2013.01); *H01J 9/003* (2013.01); *H01J 9/006* (2013.01)

(58) Field of Classification Search
CPC ..... H01K 3/32; H01J 9/003; H01J 9/006
USPC ..... 81/53.11, 53.12; 294/19.1, 19.3, 22, 23, 294/184
See application file for complete search history.

(56) References Cited

U.S. PATENT DOCUMENTS 406,744 A * 7/1889 Kriner ..... A01D 46/005 294/23
2,637,587 A * 5/1953 Robinson ..... H01J 9/006 137/855
4,314,723 A 2/1982 Vermillion
4,663,996 A 5/1987 Grudgfield et al.
5,317,939 A * 6/1994 Marinescu ..... H01K 3/32 294/100
5,692,417 A 12/1997 Irpino
6,553,872 B1 * 4/2003 Tse ..... H01K 3/32 294/184
7,131,352 B1 * 11/2006 Saunders ..... H01J 9/003 294/184
7,891,716 B2 * 2/2011 Orr ..... B25B 27/00 294/209
2010/0024606 A1 * 2/2010 Becker ..... H01K 3/32 81/53.11

* cited by examiner

*Primary Examiner* — Hadi Shakeri
*Assistant Examiner* — Danny Hong
(74) *Attorney, Agent, or Firm* — Crossley Patent Law

(57) ABSTRACT

A safety net for a light bulb changer including a base. a circular aperture continuously disposed from a top surface of the base to a bottom surface of the base, a conical semi-rigid net having a bottom end attached to the top surface of the base, a circular support frame continuously disposed on a top edge of the net, a plurality of spaced apart support columns vertically disposed along an exterior surface of the net, a conical cover continuously disposed atop an outer edge of each of the plurality of support columns, a slot disposed through a side surface of the base, and a wingnut threadably engaged in the slot. A bottom end of a rod of a light bulb changer is slidably disposed through the aperture.

4 Claims, 5 Drawing Sheets

SAFETY NET FOR A LIGHT BULB CHANGER

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of light bulb changing devices are known in the prior art. However, what has been needed is a safety net for a light bulb changer including a base, a circular aperture continuously disposed from a top surface of the base to a bottom surface of the base, a conical semi-rigid net having a bottom end attached to the top surface of the base, a circular support frame continuously disposed on a top edge of the net, a plurality of spaced apart support columns vertically disposed along an exterior surface of the net, a conical cover continuously disposed atop an outer edge of each of the plurality of support columns, a slot disposed through a side surface of the base, and a wingnut threadably engaged in the slot. What has been further needed is for a circumference of the aperture to substantially conform to a circumference of a rod on a light bulb changer. Lastly, what has been needed is for a bottom end of the rod to be slidably disposed through the aperture, and the wingnut to be configured to securely engage the base to the rod proximal a top end of the rod. The safety net for a light bulb changer thus protects a user from a falling light bulb while the user is using the light bulb changer. Furthermore, the safety net device is easily removable and securable to the rod, and the aperture can be produced in varying diameters to fit a rod of any size. The cover can optionally be a clear plastic, and the net can optionally be nylon.

FIELD OF THE INVENTION

The present invention relates to light bulb changing devices, and more particularly, to a safety net for a light bulb changer.

SUMMARY OF THE INVENTION

The general purpose of the present safety net for a light bulb changer, described subsequently in greater detail, is to provide a light bulb changing device which has many novel features that result in a safety net for a light bulb changer which is not anticipated, rendered obvious, suggested, or even implied by prior art, either alone or in combination thereof.

To accomplish this, the present safety net for a light bulb changer includes a base, a circular aperture, a conical semi-rigid net, a circular support frame, a plurality of spaced apart support columns, a conical cover, a slot, and a wingnut. The base has a top surface, a bottom surface, and a continuous side surface. The circular aperture is continuously disposed from the top surface of the base to the bottom surface of the base. A circumference of the aperture substantially conforms to a circumference of a rod on a light bulb changer. The net has a bottom end attached to the top surface of the base, a circular opening at a top edge of the net, and an exterior surface. A diameter of the top edge of the net is optionally fourteen inches, and a height of the net is optionally seventeen inches. The net is optionally nylon.

The support frame is continuously disposed on the top edge of the net. The plurality of support columns is vertically disposed along the exterior surface of the net from the bottom end of the net to the support frame. Each of the plurality of support columns has an outer edge. The conical cover is continuously disposed atop the outer edge of each of the plurality of support columns from the bottom end of the net to proximal a midpoint between the bottom end of the net and the top edge of the net. The cover is optionally plastic.

The slot is disposed through the side surface of the base. The wingnut is threadably engaged in the slot. A bottom end of the rod on the light bulb changer is slidably disposed through the aperture. The wingnut is configured to securely engage the base to the rod proximal a top end of the rod. The net is configured to protect a user from a falling light bulb as a result of the user's use of the light bulb changer.

Thus has been broadly outlined the more important features of the present safety net for a light bulb changer so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
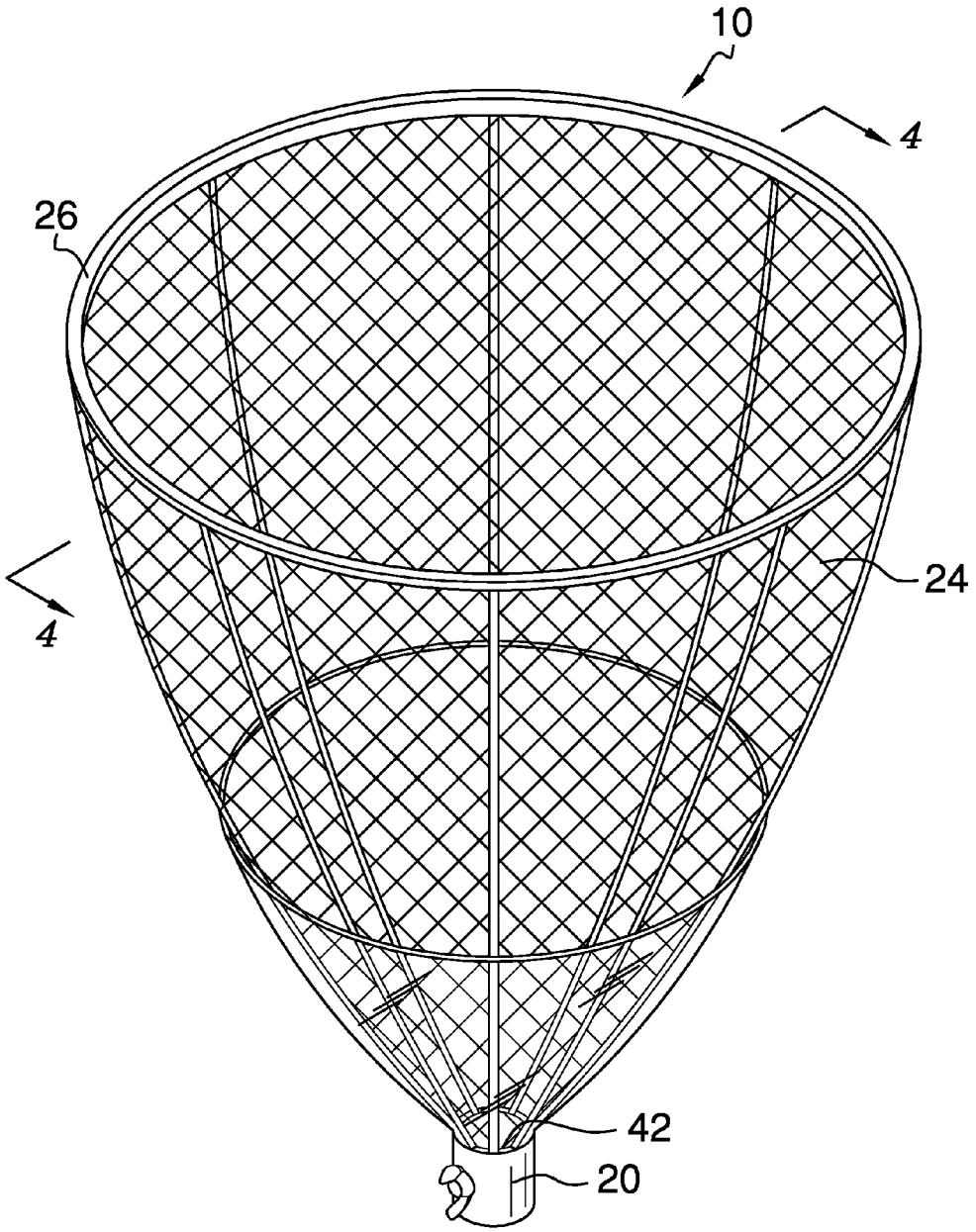
FIG. 1 is a front isometric view.
Figure 2:
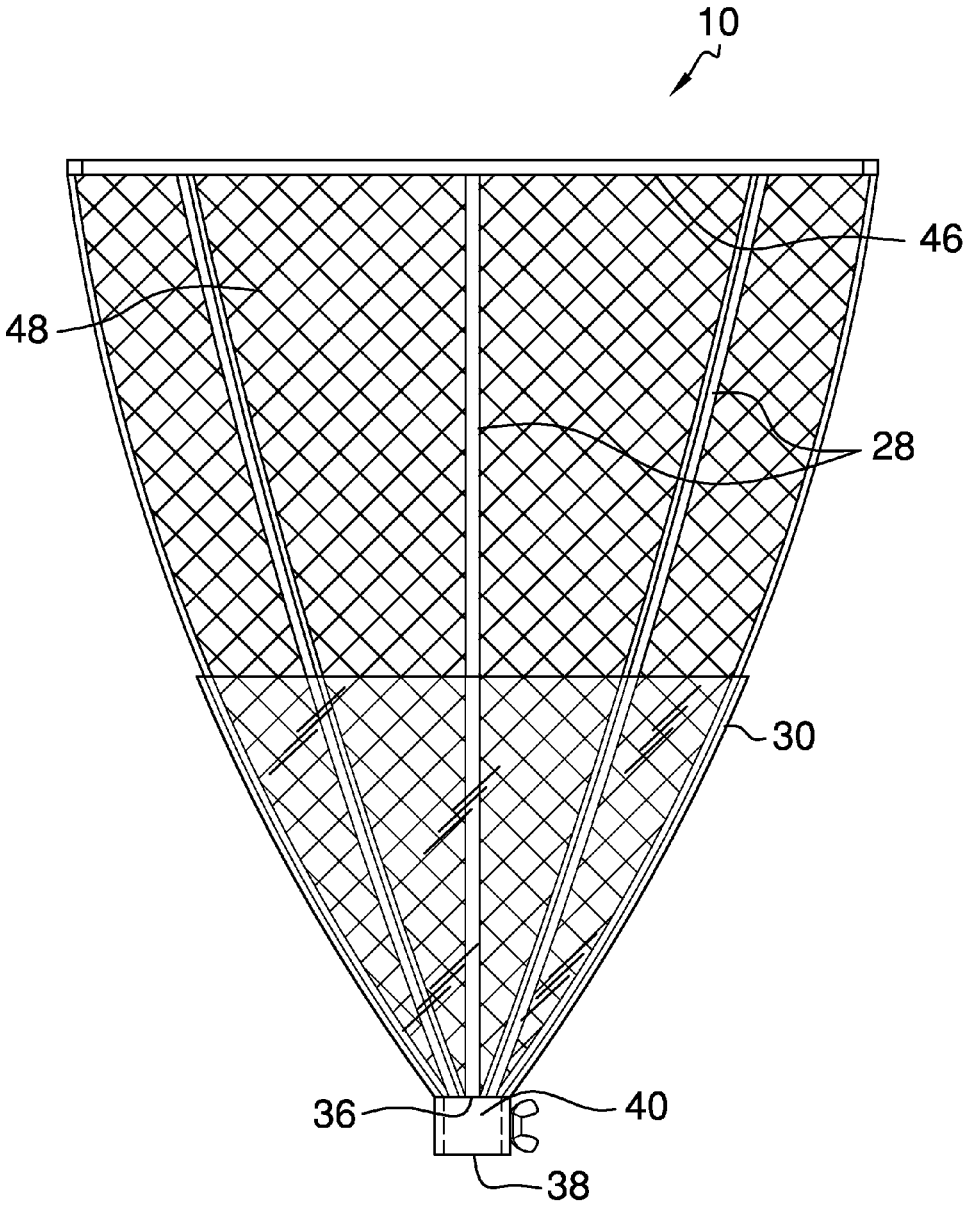
FIG. 2 is a side elevation view.
Figure 3:
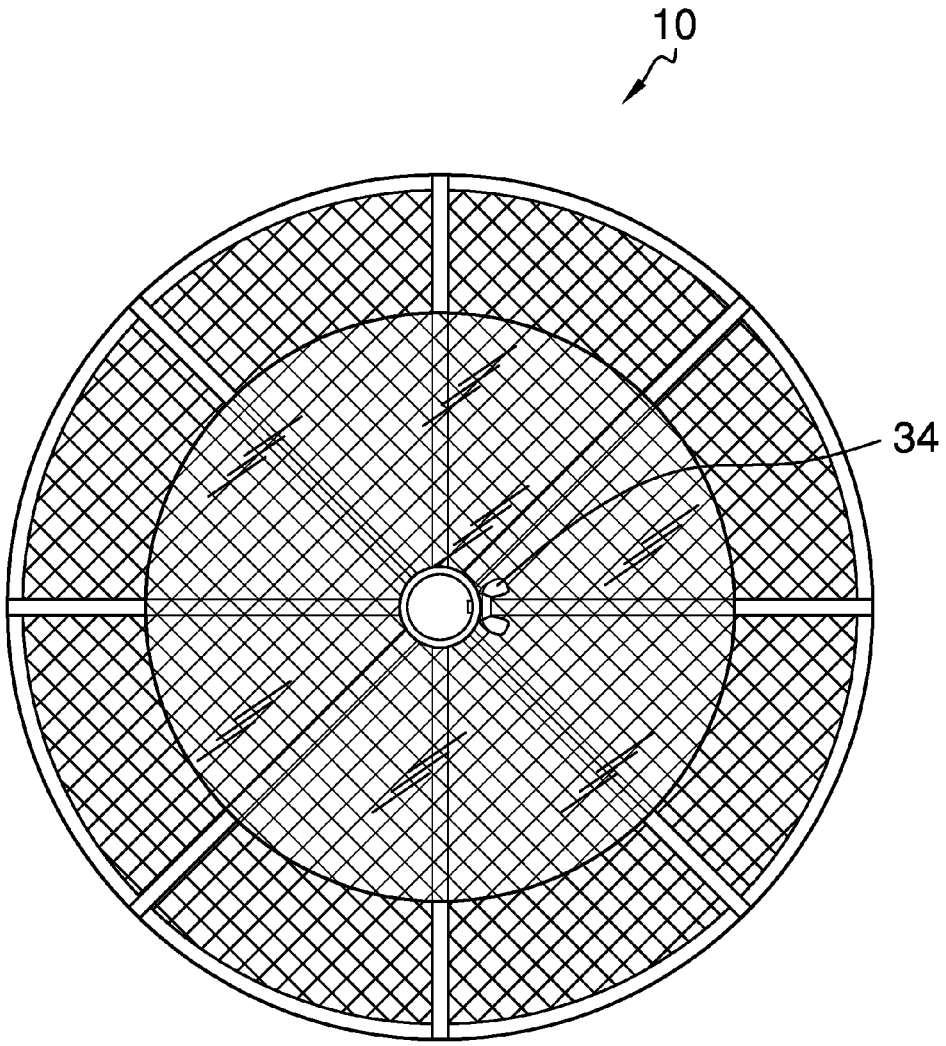
FIG. 3 is a bottom plan view.

With reference now to the drawings, and in particular FIGS. 1 through 5 thereof, an example of the instant safety net for a light bulb changer employing the principles and concepts of the present safety net for a light bulb changer and generally designated by the reference number 10 will be described.

Referring to FIGS. 1 through 5 the present safety net for a light bulb changer 10 is illustrated. The safety net for a light bulb changer 10 includes a base 20, a circular aperture 22, a conical semi-rigid net 24, a circular support frame 26, a plurality of spaced apart support columns 28, a conical cover 30, a slot 32, and a wingnut 34. The base 20 has a top surface 36, a bottom surface 38, and a continuous side surface 40. The circular aperture 22 is continuously disposed from the top surface 36 of the base 20 to the bottom surface 38 of the base 20. The net 24 has a bottom end 42 attached to the top surface 36 of the base 20, a circular opening 44 at a top edge 46 of the net 24, and an exterior surface 48.

The support frame 26 is continuously disposed on the top edge 46 of the net 24. The plurality of support columns 28 is vertically disposed along the exterior surface 48 of the net 24 from the bottom end 42 of the net 24 to the support frame 26. Each of the plurality of support columns 28 has an outer edge 50. The conical cover 30 is continuously disposed atop the outer edge 50 of each of the plurality of support columns 28 from the bottom end 42 of the net 24 to proximal a midpoint between the bottom end 42 of the net 24 and the top edge 46 of the net 24.

Figure 4:
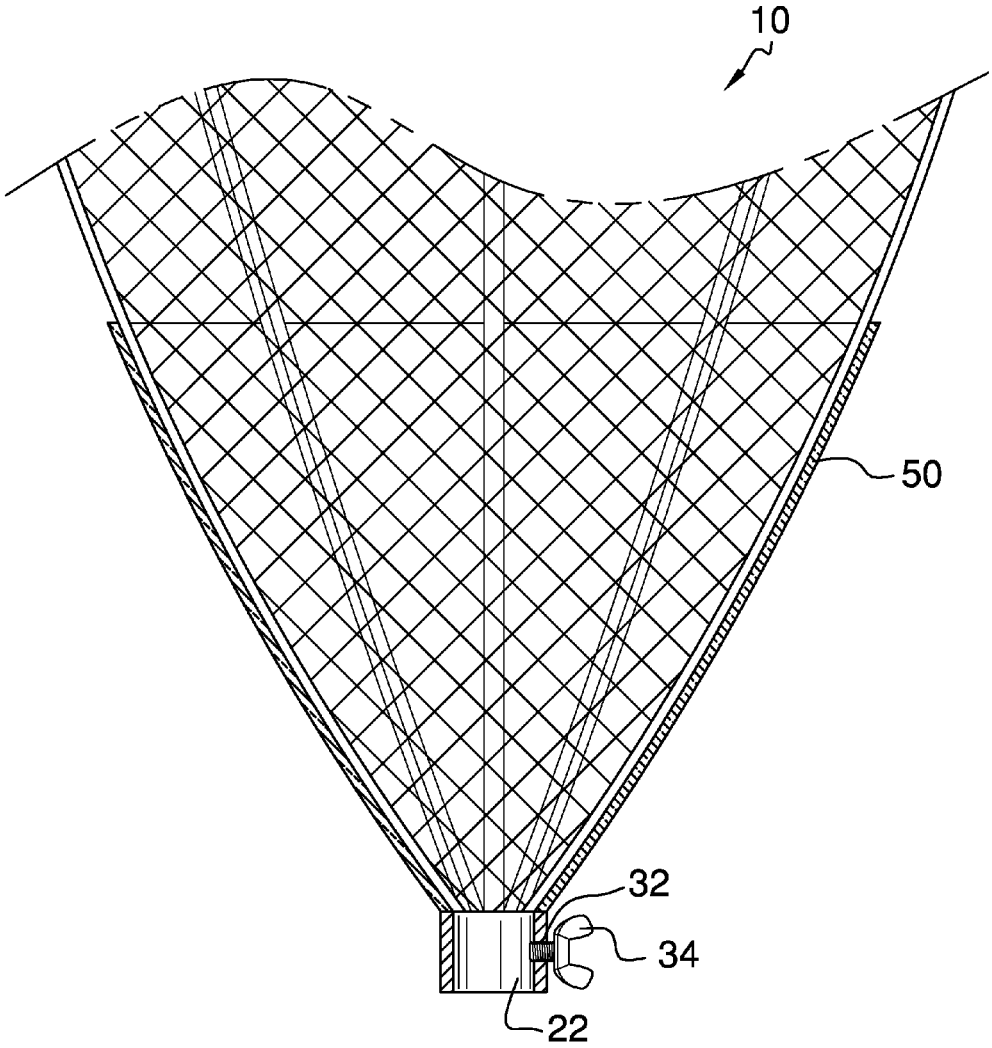
FIG. 4 is a cross-sectional view taken along line 4-4 of FIG. 1.
Figure 5:
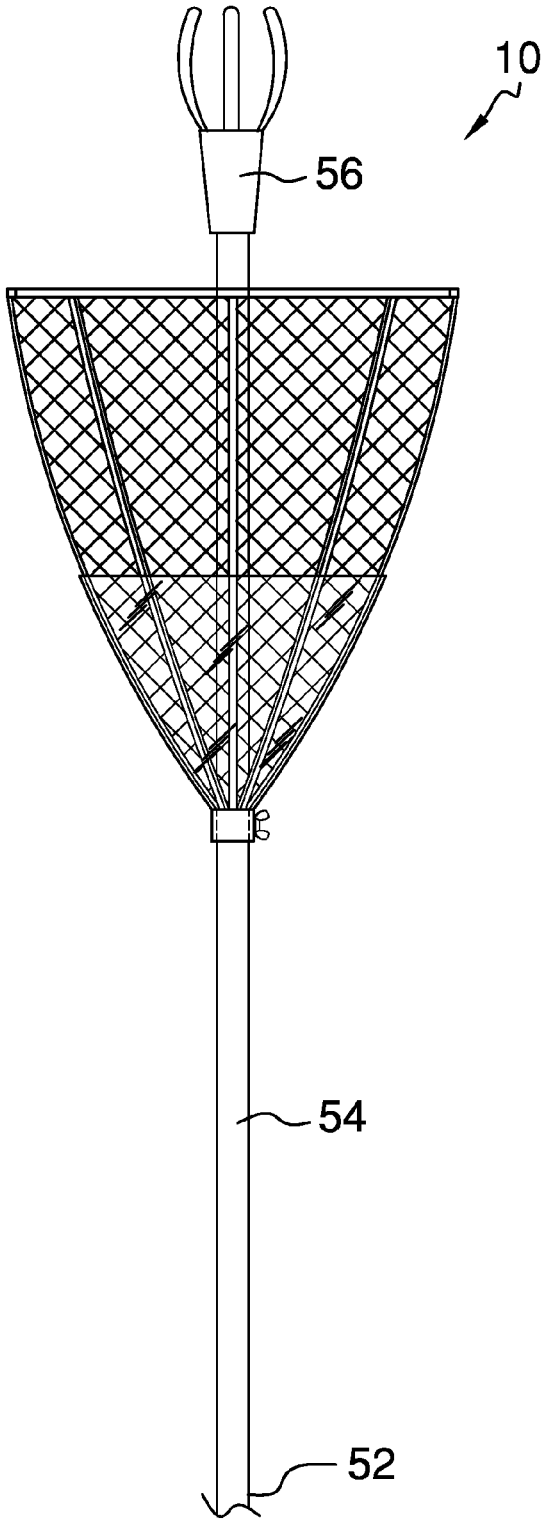
FIG. 5 is an in-use view.

As best shown in FIG. 4, the slot 32 is disposed through the side surface 40 of the base 20. The wingnut 34 is threadably engaged in the slot 32. A bottom end 52 of a rod 54 on a light bulb changer 56 is slidably disposed through the aperture 22.

What is claimed is:

1. A safety net for a light bulb changer comprising:

a base having a top surface, a bottom surface, and a continuous side surface;

a circular aperture continuously disposed from the base top surface to the base bottom surface;

a conical semi-rigid net having a bottom end attached to the base top surface, a circular opening at a top edge of the net, and an exterior surface;

a circular support frame continuously disposed on the net top edge;

a plurality of spaced apart support columns vertically disposed along the net exterior surface from the net bottom end to the support frame, each of the plurality of support columns having an outer edge;

a conical cover continuously disposed atop the outer edge of each of the plurality of support columns from the net bottom end to proximal a midpoint between the net bottom end and the net top edge;

wherein a circumference of the aperture substantially conforms to a circumference of a rod on a light bulb changer;

a slot disposed through the base side surface; and a wingnut threadably engaged in the slot;

wherein a bottom end of the rod is slidably disposed through the aperture;

wherein the wingnut is configured to securely engage the base to the rod proximal a top end of the rod;

wherein the net is configured to protect a user from a falling light bulb as a result of the user's use of the light bulb changer.

2. The safety net for a light bulb changer of claim 1 wherein a diameter of the net top edge is fourteen inches and a height of the net is seventeen inches.

3. The safety net for a light bulb changer of claim 2 wherein the cover is plastic.

4. The safety net for a light bulb changer of claim 3 wherein the net is nylon.

* * * * *